US008800220B1

(12) United States Patent
Francies, III

(10) Patent No.: US 8,800,220 B1
(45) Date of Patent: Aug. 12, 2014

(54) PRECAST CONCRETE RECESS INSERT

(71) Applicant: Sidney E. Francies, III, Lithia, FL (US)

(72) Inventor: Sidney E. Francies, III, Lithia, FL (US)

( * ) Notice: Subject to any disclaimer, the term of this patent is extended or adjusted under 35 U.S.C. 154(b) by 0 days.

(21) Appl. No.: 14/039,176

(22) Filed: Sep. 27, 2013

Related U.S. Application Data

(60) Provisional application No. 61/707,461, filed on Sep. 28, 2012.

(51) Int. Cl.
*E04G 15/04* (2006.01)
*E04G 21/14* (2006.01)

(52) U.S. Cl.
CPC ..... *E04G 21/142* (2013.01)
USPC ..... 52/125.5; 52/699; 249/96; 249/91

(58) Field of Classification Search
CPC ..... E04B 1/4121; E04B 1/38; E04G 21/142; B22C 9/06
USPC ..... 52/125.4, 125.5, 576, 699, 701; 249/91, 249/94, 96
See application file for complete search history.

(56) References Cited

U.S. PATENT DOCUMENTS

| | | | | |
|---|---|---|---|---|
| 2,838,821 | A * | 6/1958 | Shur | 24/662 |
| 4,821,994 | A * | 4/1989 | Fricker | 249/91 |
| 6,082,700 | A * | 7/2000 | Lancelot et al. | 249/91 |
| 6,095,483 | A * | 8/2000 | Mackay Sim et al. | 249/175 |
| 6,460,824 | B1 * | 10/2002 | Lancelot et al. | 249/91 |
| 6,575,424 | B2 * | 6/2003 | Domizio | 249/91 |
| 6,769,663 | B2 * | 8/2004 | Kelly et al. | 249/91 |
| 7,127,859 | B2 * | 10/2006 | Domizio | 52/576 |
| 2002/0134905 | A1 * | 9/2002 | Domizio | 249/91 |
| 2002/0195537 | A1 * | 12/2002 | Kelly et al. | 249/91 |
| 2008/0196324 | A1 * | 8/2008 | Mackay Sim | 52/125.4 |
| 2008/0203270 | A1 * | 8/2008 | Connell et al. | 249/94 |
| 2009/0183441 | A1 | 7/2009 | Azarin | |
| 2011/0191990 | A1 * | 8/2011 | Beaulieu | 24/457 |

FOREIGN PATENT DOCUMENTS

| | | | |
|---|---|---|---|
| AU | 2009217422 | A1 | 4/2010 |
| WO | WO 2012140329 | A1 * | 10/2012 |

OTHER PUBLICATIONS

Walson Industrial Co., Limited; ARRF A-Anchor rubber recess former; http://www.walson.biz/pro_see.asp?nidn_rh393_34_54_dfd_46=67&xiaolei=778; 1 page; Copyright 2009; Shanghai, China.

* cited by examiner

*Primary Examiner* — Robert Canfield
*Assistant Examiner* — Babajide Demuren
(74) *Attorney, Agent, or Firm* — McGarry Bair PC

(57) ABSTRACT

A Portland cement concrete recess insert is characterized by a quadrant shape, an obverse wall, a contact wall, and a convex wall. The obverse wall is coupled orthogonally with the contact wall along a contact line, and extends laterally of the convex wall to define a perimetric flange. The convex wall is coupled with the obverse wall and the contact wall radially opposite the contact line. A pair of recess inserts is connectable along the contact walls to define a semicircular convex wall. A bilaterally symmetrical open channel traverses the contact wall and intercepts the convex wall at two locations. The pair of recess inserts is mutually joinable along the contact walls to juxtapose the open channels and define a closed channel to enclose a portion of a lift anchor.

23 Claims, 10 Drawing Sheets

PRECAST CONCRETE RECESS INSERT

CROSS-REFERENCE TO RELATED APPLICATION

This application claims the benefit of U.S. provisional application Ser. No. 61/707,461, filed Sep. 28, 2012, which is incorporated by reference herein in its entirety.

BACKGROUND OF THE INVENTION

The invention relates generally to a recess insert for a lifting assembly utilized in handling precast Portland cement concrete shapes. In another aspect, the invention relates to a recess insert comprising two identical coupleable pieces that can engage a lift anchor and form a cavity in the concrete so that lifting apparatuses can readily access the lift anchor for handling concrete shapes, and the recess insert can be readily removed and reused.

It is known to utilize concrete shapes that are pre-cast prior to shipment and installation on a construction project. Frequently, such shapes can be very heavy and must be removed from a mold, placed on a transporting vehicle, and installed at the construction site using lifting apparatuses, including cranes, helicopters, and other heavy equipment. Lifting apparatuses frequently include hooks, cables, chains, and the like, that couple concrete shapes with cranes, helicopters, and the like.

To facilitate coupling of hooks, cables, chains, and the like, to concrete shapes, the shapes are typically fabricated to include metallic lifting anchors integrated into the concrete. Frequently, metallic lifting anchors are attached to a recess insert which envelops that portion of the lifting anchor that must remain exposed. As fresh concrete is placed, the recess insert prevents the concrete from overflowing the exposed part of the lifting anchor. When the concrete has cured, the recess insert can be removed, and the lifting anchors will be partly embedded in the concrete and partly exposed for connecting the hooks, cables, chains, and other lifting and transporting apparatus.

Known recess inserts may be fabricated of materials that are relatively nonresistant to the corrosive effects of fresh concrete. Recess inserts may also have a configuration that is relatively ineffective at preventing fresh concrete from enveloping the exposed part of the lifting anchor, typically as a result of a recess insert design that is focused on ready removal of the recess insert from the cured concrete without specialized tools or interference from the cured concrete.

A need exists for a recess insert that is more effective at preventing the undesirable influx of fresh concrete around a lifting anchor, while enabling ready removal of the recess insert from the cured concrete.

BRIEF DESCRIPTION OF THE INVENTION

A Portland cement concrete recess insert is characterized by a quadrant shape, an obverse wall, a contact wall, and a convex wall. The obverse wall is coupled orthogonally with the contact wall along a contact line, and extends laterally of the convex wall to define a perimetric flange. The convex wall is coupled with the obverse wall and the contact wall radially opposite the contact line. A pair of recess inserts is connectable along the contact walls to define a semicircular convex wall. A bilaterally symmetrical open channel traverses the contact wall and intercepts the convex wall at two locations. The pair of recess inserts is mutually joinable along the contact walls to juxtapose the open channels and define a closed channel to enclose a portion of a lift anchor.

DESCRIPTION OF AN EMBODIMENT OF THE INVENTION

As may be used herein, the following terms have the associated definitions unless otherwise indicated:

"Axis" means "a real or imaginary straight line about which a three-dimensional body is symmetrical or nominally symmetrical."

"Longitudinal" with respect to a body means "correlating with the axis of a body that is parallel to the longitudinal axis of the assembled precast concrete building panel."

"Plane of symmetry" means "a real or imaginary plane that divides a body such that each side of the body is a mirror reflection of the other."

A combination Portland cement concrete recess insert and lifting anchor may have wide applicability in environments different than that described herein. The invention may be described herein in connection with one or more exemplary embodiments, all of which may share features and functionalities. A subsequent detailed description of shared features and functionalities herein may be omitted except as necessary for a complete understanding of the embodiments. The invention may be utilized for other than the exemplary embodiments that may be disclosed, and such embodiments are not to be construed in any way as limiting the scope of the claims.

Figure 1:
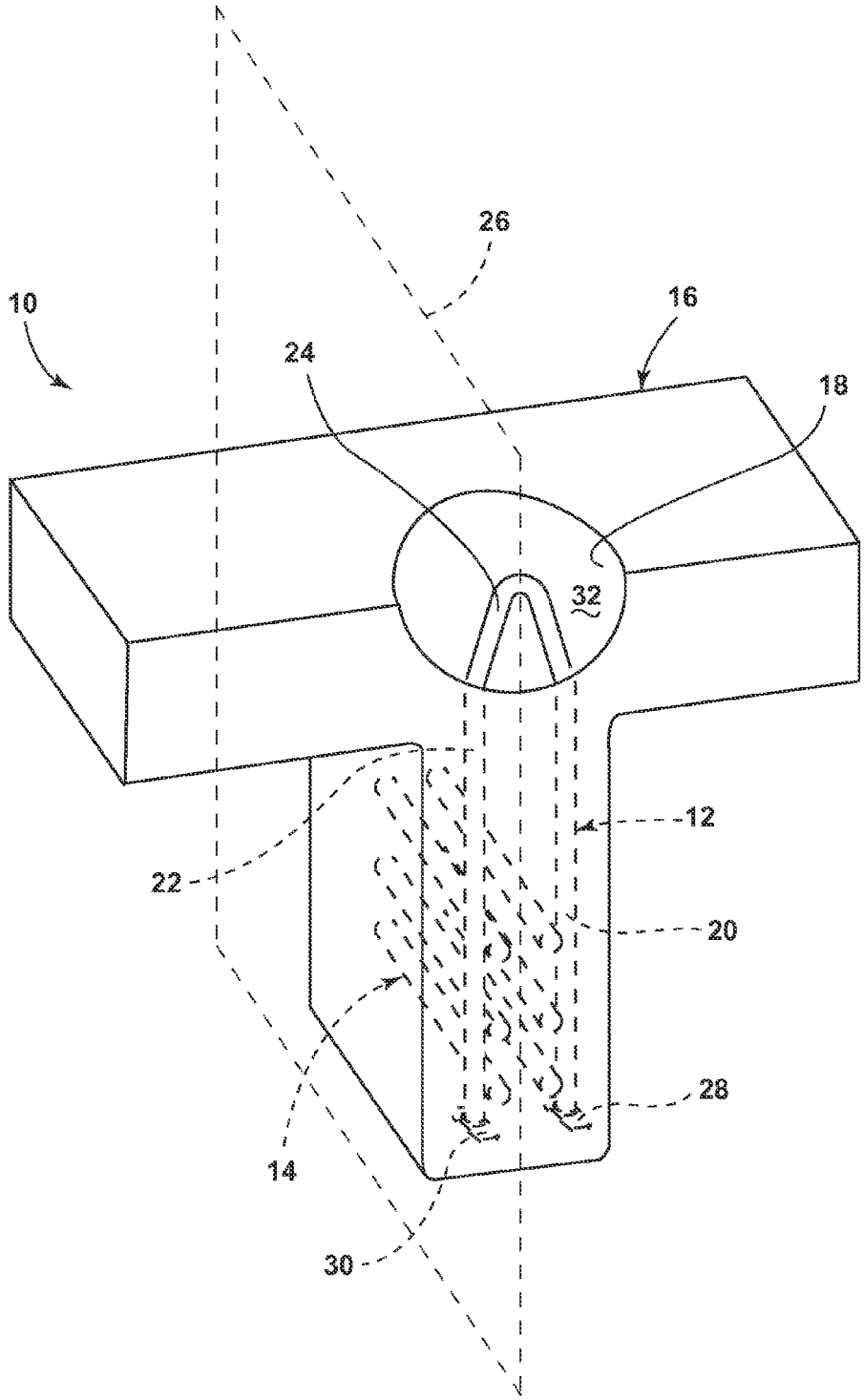
FIG. 1 is a perspective view of a prefabricated concrete tee in which a cavity is formed to enable access to a concrete lift anchor according to an embodiment of the invention.

Referring now to the figures, and to FIG. 1 in particular, an exemplary embodiment according to the invention comprising a portion of a concrete lift assembly 10 is shown including a lift anchor 12 partially embedded in a precast Portland cement concrete shape 16 in the form of a tee. The shape 16 may include embedded reinforcing bars 14. The lift anchor 12 may include a first anchor leg 20 and a second anchor leg 22 in generally parallel disposition, transitioning to an inverted somewhat vee-shaped anchor lift head 24. The first anchor leg 20 can terminate in a first anchor foot 28, and the second anchor leg 22 can terminate in a second anchor foot 30. The concrete shape 16 is characterized by a lift anchor recess 18 defining a lift anchor cavity 32 in which the lift head 24 is exposed and accessible for connecting of lifting apparatuses (not shown). The concrete lift assembly 10, including the concrete shape 16, may be characterized by a longitudinal plane of symmetry 26 dividing the concrete lift assembly 10 into two mirror images.

Figure 2:
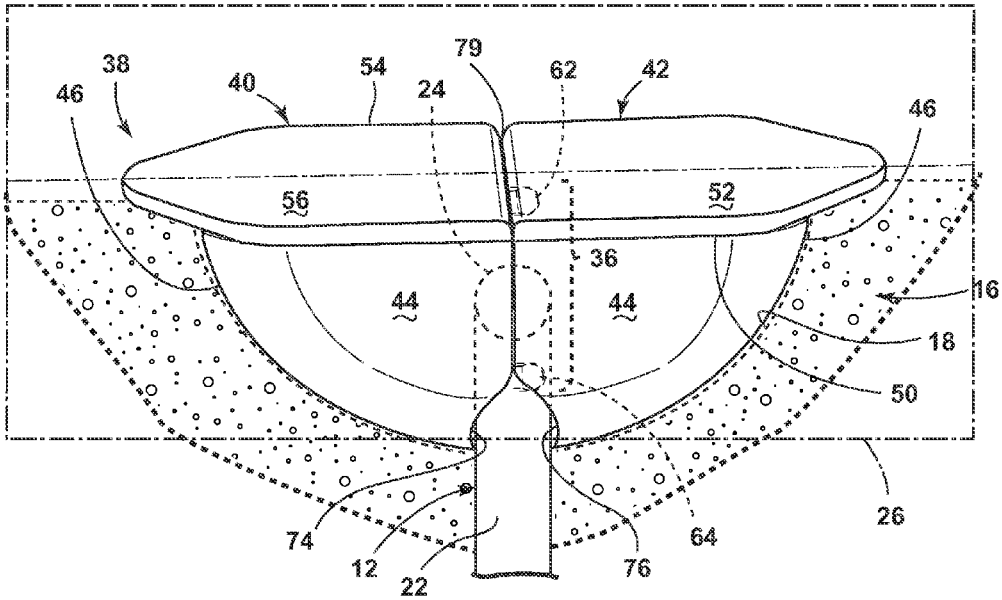
FIG. 2 is a perspective, partial cutaway view of a pair of recess inserts temporarily embedded in prefabricated concrete for forming the cavity illustrated in FIG. 1, and coupled with a concrete lift anchor.
Figure 3A:
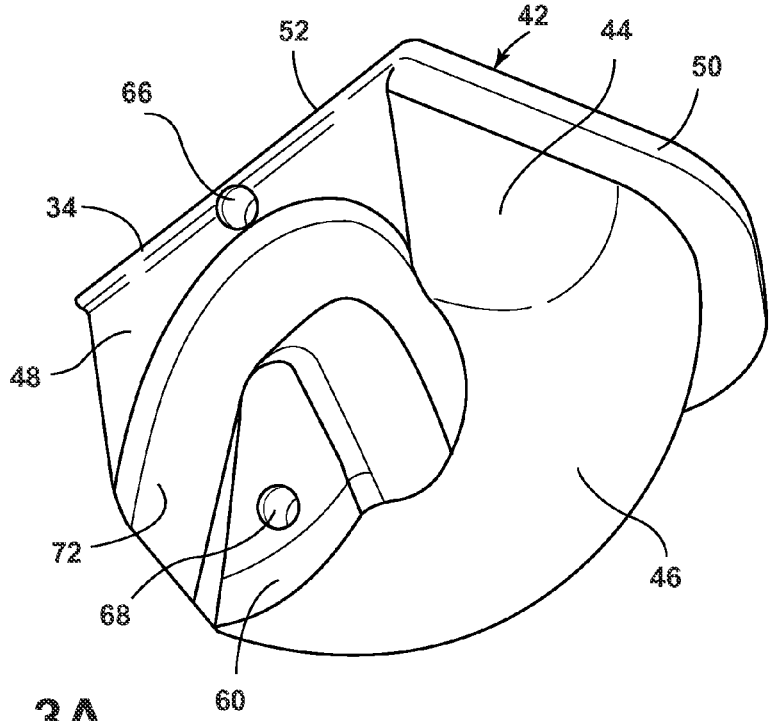
FIGS. 3A-B are perspective views of the pair of recess inserts of FIG. 2 illustrating functionalities for coupling the recess inserts together and engaging the concrete lift anchor.
Figure 3B:
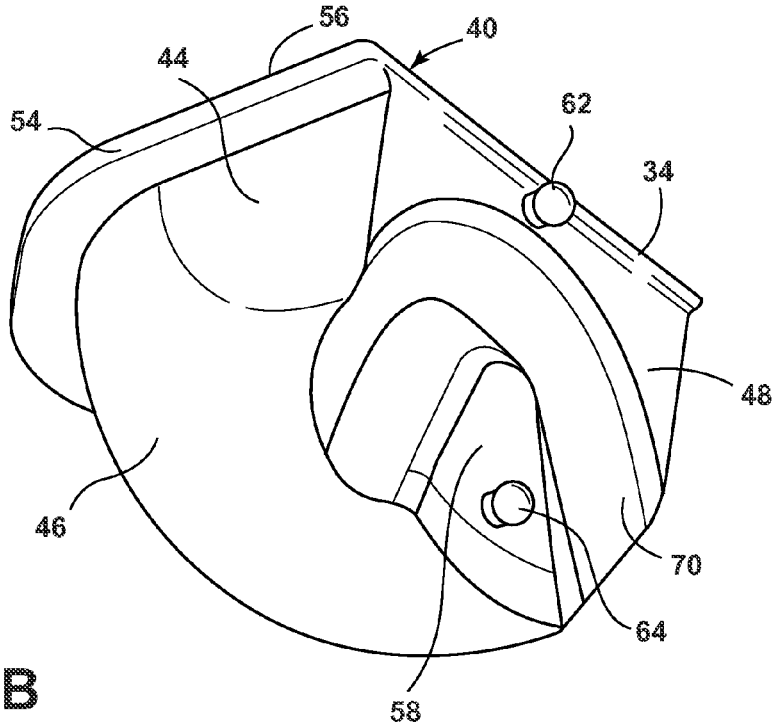

FIGS. 2, 3A, and 3B illustrate a first embodiment recess insert 38 for forming the lift anchor cavity 32. The recess insert 38 can comprise a pair of somewhat quadrant shaped bodies, i.e. a first recess insert quadrant 40 and a second recess insert quadrant 42. The first quadrant 40 can be characterized by a planar obverse wall 56, a planar contact wall 48, and a convex curved wall 46. The second quadrant 42 can be characterized by a planar obverse wall 52, a planar contact wall 48, and a convex curved wall 46. The planar obverse walls 52, 56 can each be coupled orthogonally to a planar contact wall 48 along a contact line 34. The convex curved wall 46 can be coupled with the planar obverse wall 52, 56 and the planar contact wall 48 radially opposite the contact line 34. Thus, the obverse wall 52, 56, planar contact wall 48, and convex curved wall 46 can comprise a recess insert quadrant 40, 42 having an uninterrupted surface.

Alternatively, as illustrated in FIGS. 2, 3A, and 3B, a quadrant-shaped planar sidewall 44 can transition from the convex curved wall 46 to orthogonally intercept the planar obverse wall 52, 56 and the planar contact wall 48.

The planar obverse wall 52, 56 can extend laterally of the longitudinal plane of symmetry 26 and the convex curved wall 46 to define a perimetric flange 50, 54. It may be recognized that the longitudinal plane of symmetry 26 is oriented orthogonal to the planar contact wall 48 and parallel to the planar sidewalls 44 and, thus, intersects the planar obverse wall 52, 56 at the furthest point from the planar contact wall 48.

In FIG. 3A, the planar contact wall 48 of the second recess insert quadrant 42 is traversed by a bilaterally symmetrical anchor lift head open channel 72. The channel 72 is characterized by an inverted vee-shape, and intercepts the convex curved wall 46 at two locations 76 (FIG. 2). The portion of the planar contact wall 48 adjacent the planar obverse wall 52 can include a first opening 66. The channel 72 separates the planar contact wall 48 into a first projection 60 having a second opening 68. The openings 66, 68 can be aligned so that an imaginary line passing diametrically through the center of each opening 66, 68 will be orthogonal to the planar obverse wall 52.

In FIG. 3B, the planar contact wall 48 of the first recess insert quadrant 40 is traversed by a bilaterally symmetrical anchor lift head open channel 70 characterized by an inverted vee-shape. The channel 70 intercepts the convex curved wall 46 at two locations 74 (FIG. 2) complementary to the two locations associated with the channel 72. The portion of the planar contact wall 48 adjacent the planar obverse wall 56 can include a first spherical head fastener 62. The channel 70 separates the planar contact wall 48 into a second projection 58 having a second spherical head fastener 64. The fasteners 62, 64 can be aligned so that an imaginary line passing diametrically through the center of each spherical head will be orthogonal to the planar obverse wall 56.

The spherical head fasteners 62, 64 and the openings 66, 68 can be adapted, respectively, for frictional engagement. The spherical head fasteners can be fabricated of a material having a suitable strength and durability for the purposes described herein. A nylon may be such a material. The spherical head fasteners may be removably insertable into openings identical to the openings 66, 68 so that as the spherical heads may wear, or become lost or broken, they can be readily replaced. Thus, the insert quadrants 40, 42 may be seen to be identical and, thus, may be fabricated using a single mold fixture or set of fixtures. Furthermore, having identical openings in both recess insert quadrants 40, 42 may enable the spherical head fastener 62 to be inserted in the opening 66, thus having one opening and one spherical head fastener for each recess insert quadrant.

Figure 4:
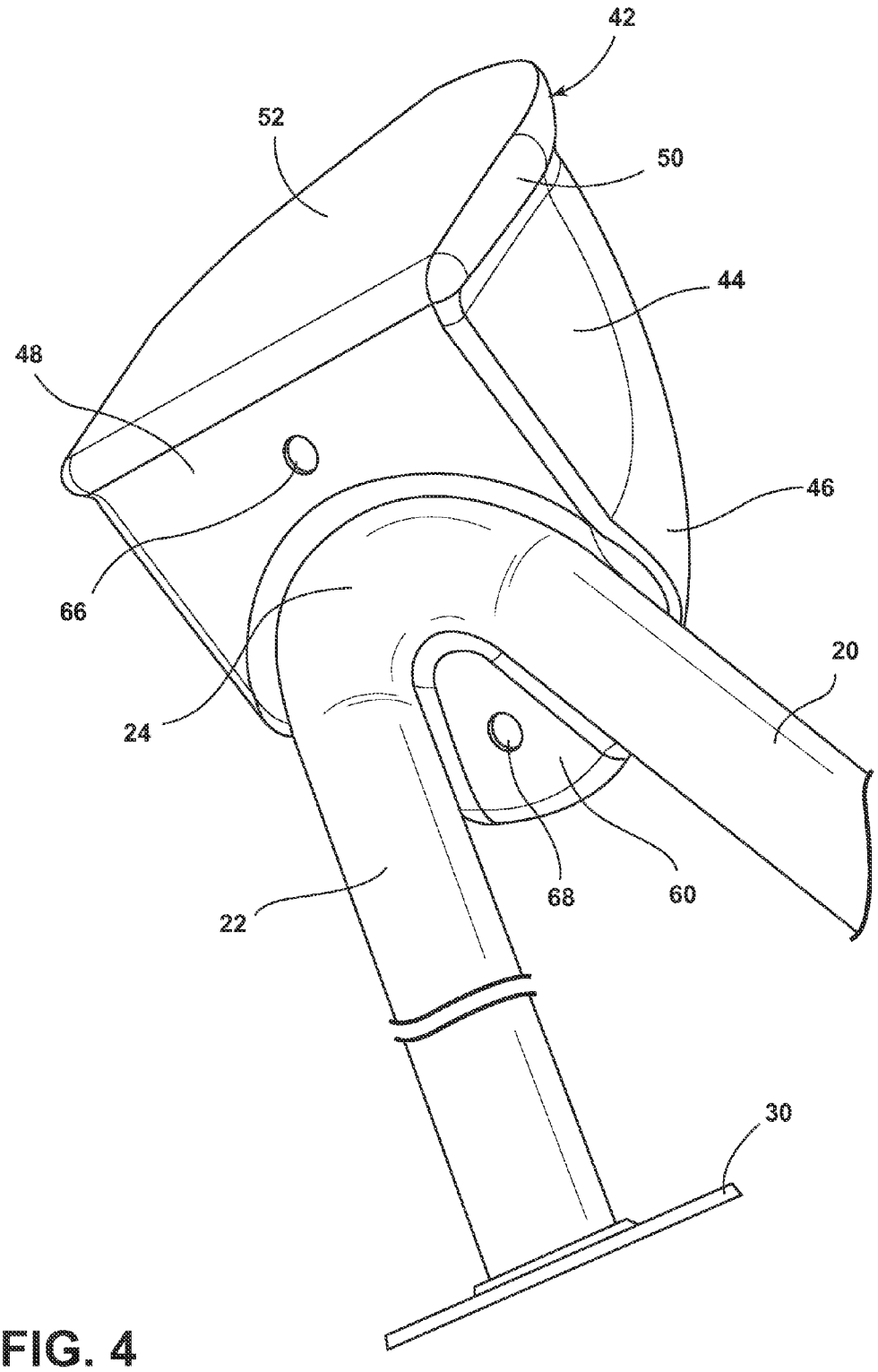
FIG. 4 is a perspective view of the recess insert of FIG. 3A engaging a concrete lift anchor.

Referring now to FIG. 4, a recess insert quadrant 42 is illustrated with a lift anchor head 24 received in the channel 72. The shape and depth of the channels 70, 72 will be selected based upon the size of the lift anchor. As FIG. 4 makes clear, the lift anchor can be securely retained in the channel 72, thereby minimizing movement of the lift anchor relative to the recess insert. When the recess insert quadrants 40, 42 are joined together by inserting the spherical head fasteners 62, 64 into the openings 66, 68, respectively, the lift anchor head 24 will be enveloped within the resulting closed channel. This can also be seen in FIG. 2 in which the closed channel is identified by the second lip 74 and first lip 76.

Figure 5:
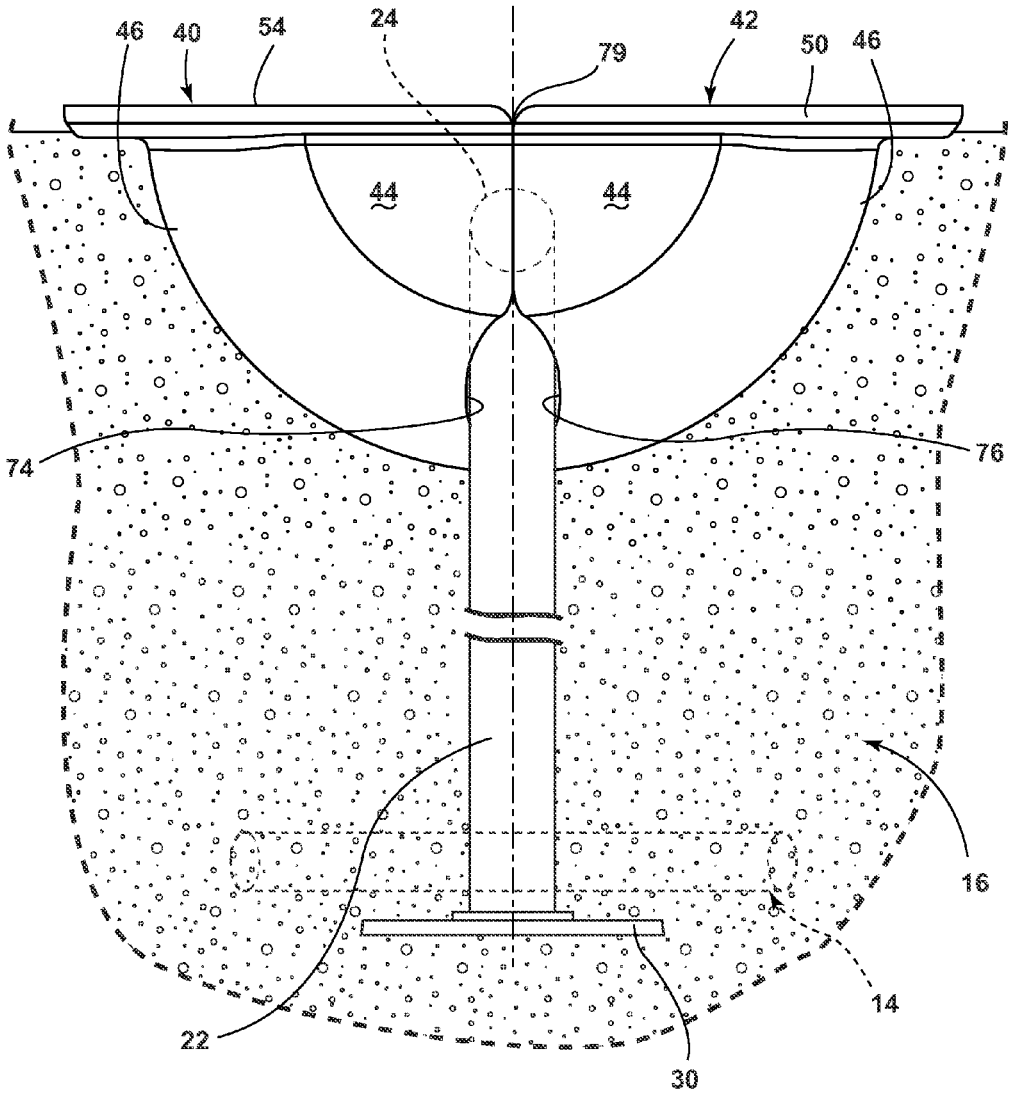
FIG. 5 is a partly cutaway elevation view of the recess insert and lift anchor of FIG. 2 oriented within precast concrete for formation of the cavity.

As shown in FIG. 5, the recess insert quadrants 40, 42 can be coupled together around a lift anchor head 24 along their respective planar contact walls 48. Fresh concrete 16 can be placed so that the flanges 50, 54 can extend along the surface of the concrete. The recess insert 38 can displace the concrete in order to form the cavity 32. Any fresh concrete residue, i.e. water, mortar, loose slurry, and the like, that may enter the closed channel 74, 76 will remain on the exterior of the recess insert quadrants 40, 42, and can be readily cleaned from the quadrants 40, 42 at the end of the concrete placement.

Figure 6:
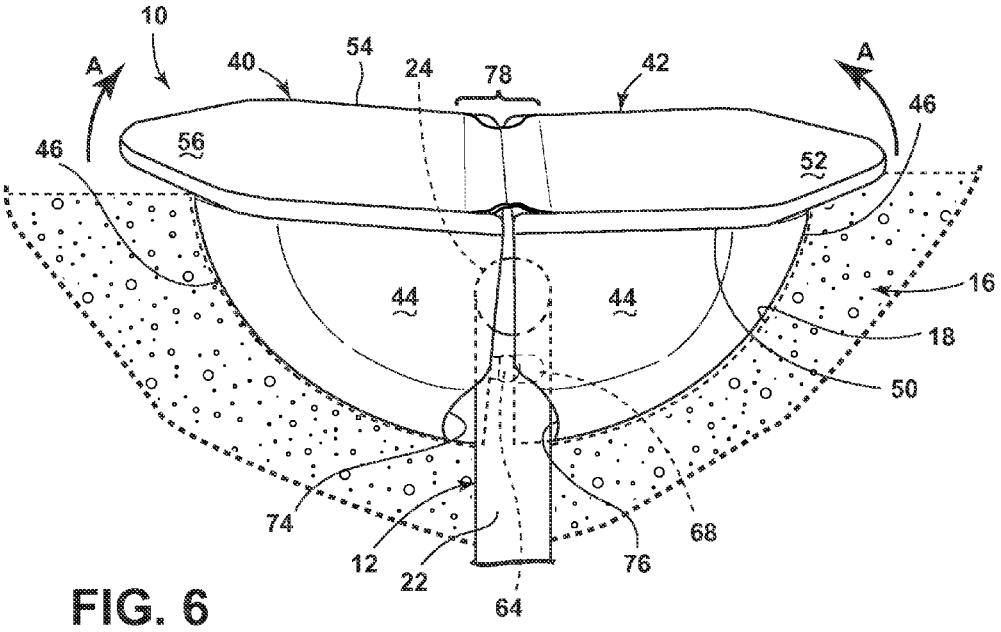
FIG. 6 is a perspective, partial cutaway view of a pair of recess inserts according to a second embodiment of the invention illustrating removal of the recess inserts from the cavity.

Referring now to FIG. 6, the recess insert 38 is illustrated during the process of removing the quadrants 40, 42 out of the lift anchor cavity 32 and away from the anchor lift head 24. This can be accomplished by lifting up on one of the flanges 50, 54 (in this example flange 54) and rotating the quadrant 40 out of the cavity 32. Fabricating the quadrants in order to produce and maintain smooth outer walls 44, 46 can facilitate removal of the quadrants from the cured concrete. This may be a significant factor in determining the material from which the quadrants 40, 42 may be fabricated. FIG. 6 illustrates the quadrants 40, 42 coupled together by a recess insert connector 78. The recess insert connector 78 can be a known pin-type hinge, a flat plastic piece having a flexible living hinge, a removable strap to enable use of the uncoupled quadrants 40, 42, and the like.

Figure 7:
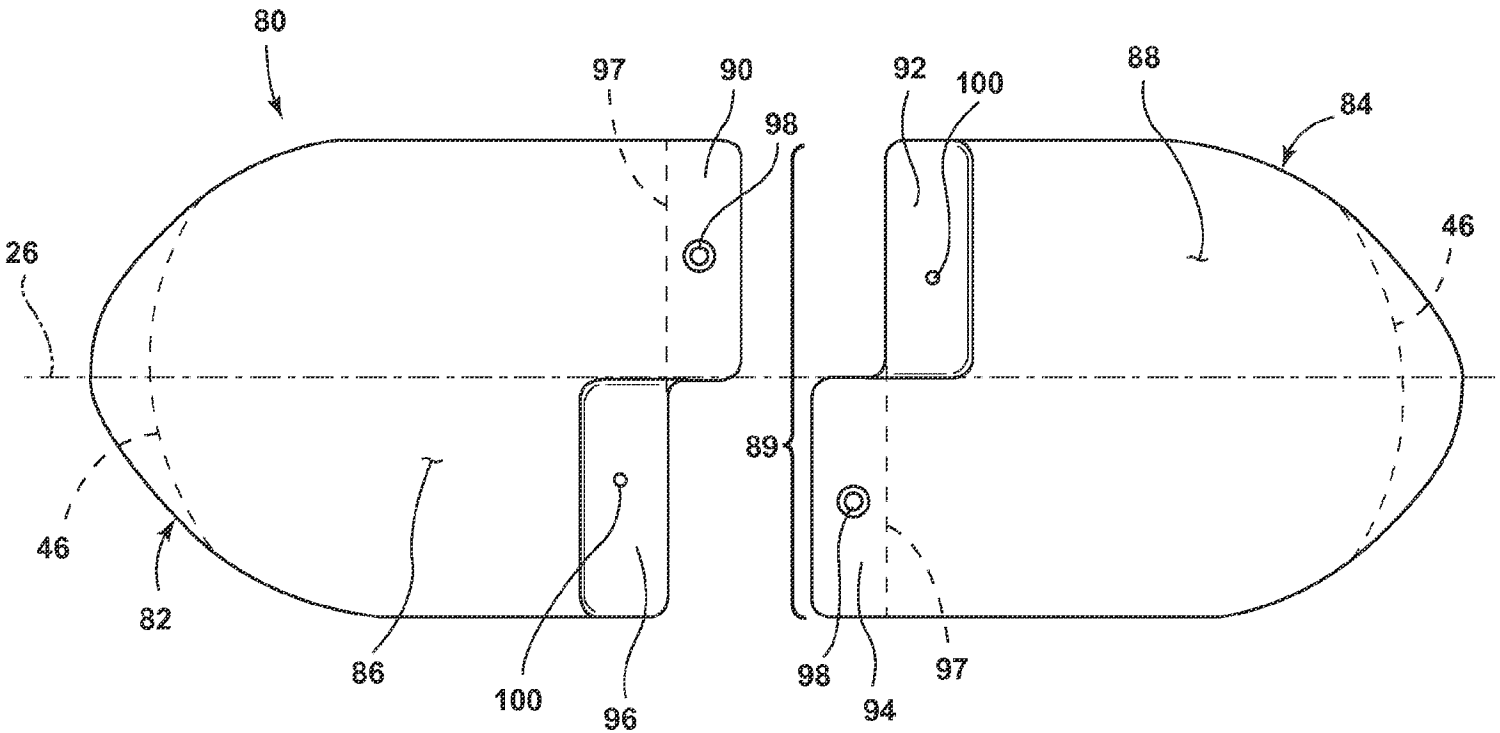
FIG. 7 is an exploded plan view of a pair of recess inserts according to a third embodiment of the invention.
Figure 8:
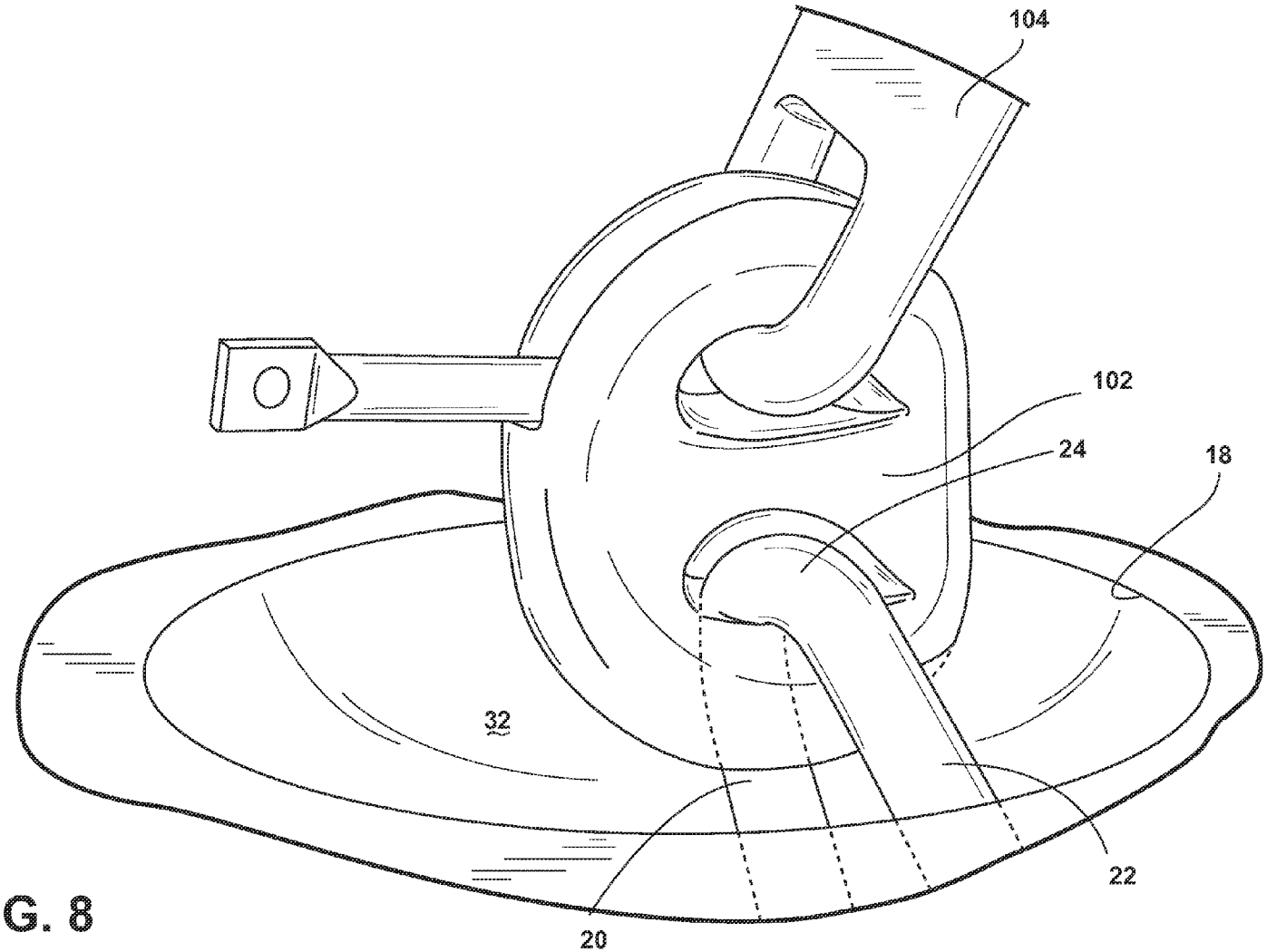
FIG. 8 is a perspective, partial view of a concrete lift anchor embedded in a cavity in precast concrete and coupled with a lifting apparatus.

FIG. 7 illustrates a second embodiment recess insert 80 including a third recess insert quadrant 82, and a fourth recess insert quadrant 84. The sidewalls 44, convex curved walls 46, and contact walls 48 are as described hereinbefore. The third recess insert quadrant 82 includes a third planar obverse wall 86, and the fourth recess insert quadrant 84 includes a fourth planar obverse wall 88. The two quadrants 82, 84 can be coupled together through a third recess insert connector 89, as follows.

The third planar obverse wall 86 differs on either side of the longitudinal plane of symmetry 26. On one side, the obverse wall 86 extends beyond the contact wall 48 to define a connecting tab 90 having a fastener opening 98 therethrough. On the other side of the longitudinal plane of symmetry 26, the obverse wall steps downwardly into a connecting tab recess 96 having a fastener receptacle 100 therethrough.

It may be readily apparent that the third recess insert quadrant 82 is identical to the fourth recess insert quadrant 84. Thus, the obverse wall 88 extends beyond of the contact wall 48 to define a connecting tab 94 having a fastener opening 98 therethrough. Opposite the longitudinal plane of symmetry 26, the obverse wall steps downwardly into a connecting tab recess 92 having a fastener receptacle 100 therethrough. As illustrated in FIG. 7, the tab 90 can engage the recess 92 and the tab 94 can engage the recess 96. Threaded fasteners can be driven through the fastener openings 98 into the fastener receptacles 100 to couple the quadrants 82, 84 into a unified recess insert. As with the embodiment illustrated in FIG. 6, the quadrants 82, 84 can rotate about a hinge line for facilitating removal of the insert 82, 84 from a cavity and a lifting anchor.

Figure 9:
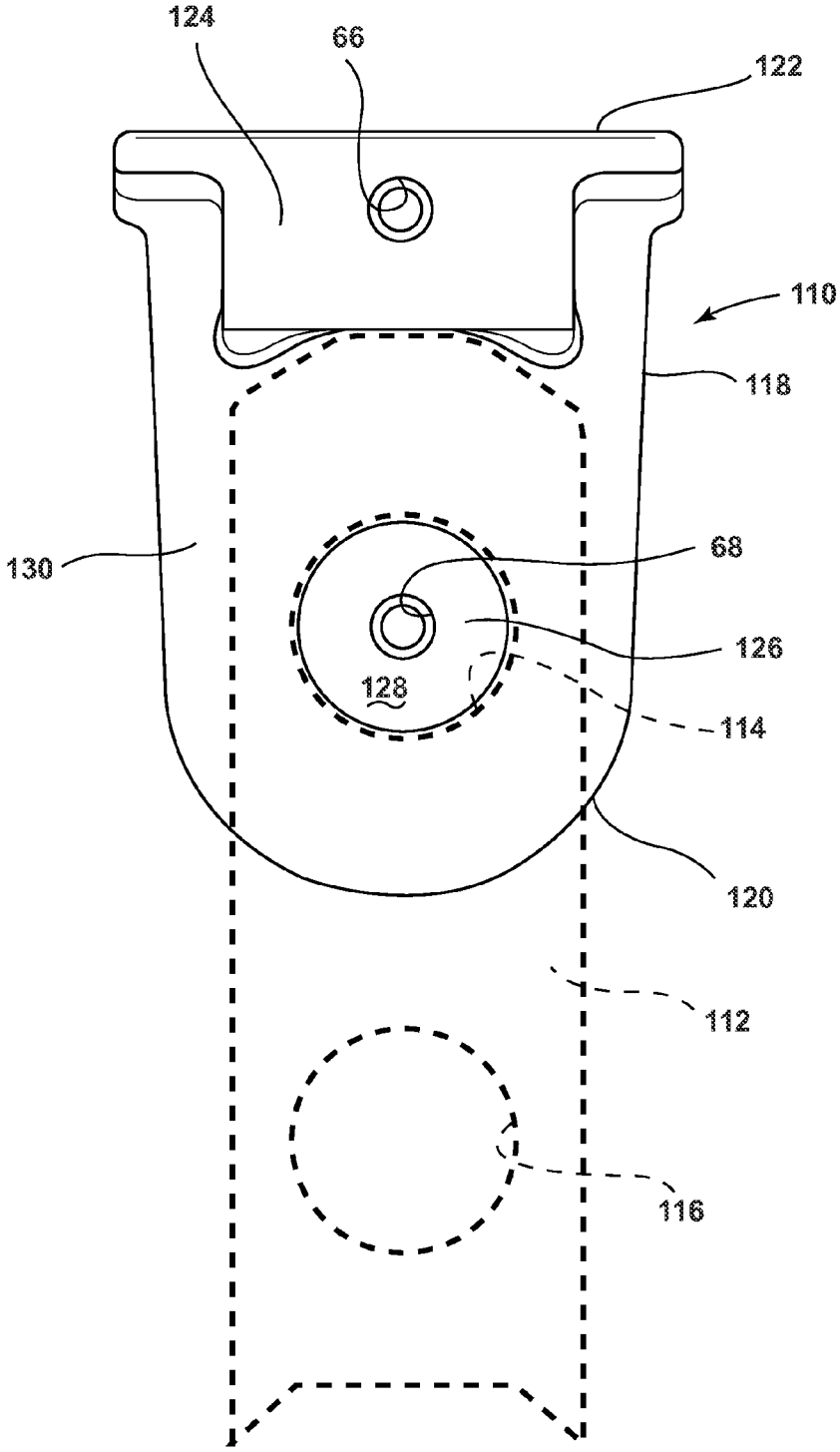
FIG. 9 is an elevation view of a recess insert according to a fourth embodiment of the invention.

FIG. 9 illustrates a third embodiment recess insert 110 adapted for use with a plate-like lift anchor 112. The lift anchor 112 is a generally elongated plate like body including a circular lift ring opening 114 and a circular anchor bar opening 116. The diameters of the openings 114, 116 can be selected based upon the size of the lifting apparatus, i.e. a lift ring, and the diameter of an anchor bar.

The recess insert 110 can be joined with an identical recess insert (not shown) in a manner generally as described herein. The recess insert 110 can have a pair of planar sidewalls 118 transitioning to a convex curved wall 120. The planar sidewalls 118 can transition to planar obverse wall 122 and a planar contact wall 124. A planar recessed wall 130 can extend parallel to and away from the contact wall 124. A lift ring opening pedestal 126 characterized by a pedestal contact face 128 can extend away from the recessed wall 130 so that the contact face 128 is coplanar with the contact wall 124. The depth of the contact wall 124 and pedestal contact face 128 can be selected to correspond with one-half the thickness of the anchor bar 112.

The lift ring opening pedestal 126 can have a coaxial opening 68. The contact wall 124 can have an opening 66. A second recess insert identical to the illustrated insert 110 can be coupled with the illustrated insert 110 by utilizing spherical head fasteners, as previously described. The lift anchor bar 112 can be placed against the recessed wall 130 with the pedestal 126 inserted through the lift ring opening 114. The second recess insert can be aligned and coupled with the illustrated insert 110 so that the lift anchor bar 112 is sandwiched between the two recess inserts, the contact walls 124 are joined together, and the pedestal contact faces 128 are joined together. As with the previously described embodiments, the recess inserts 110 can be readily separated and removed from the lift anchor cavity 32 and lift anchor 112.

Figure 10A:
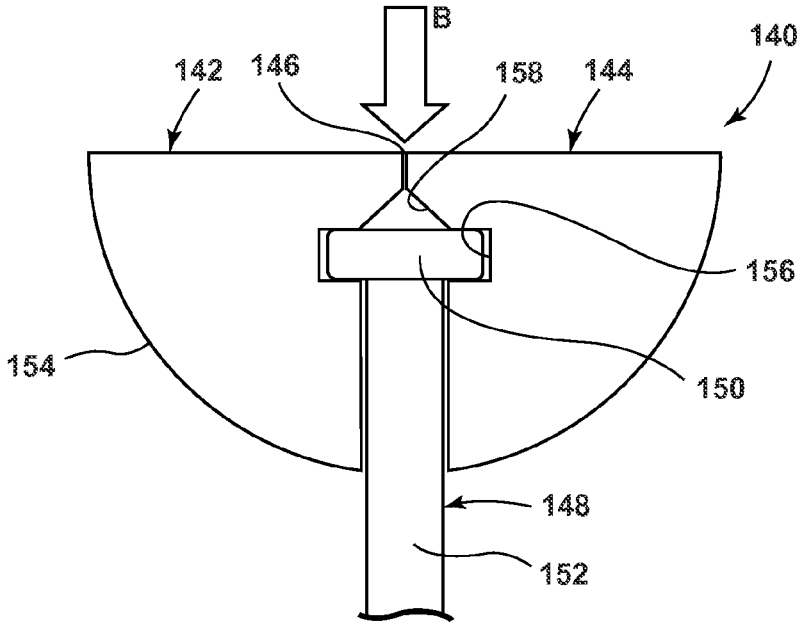
FIGS. 10A-C are schematic plan and elevation views of a recess insert according to a fifth embodiment of the invention.
Figure 10B:
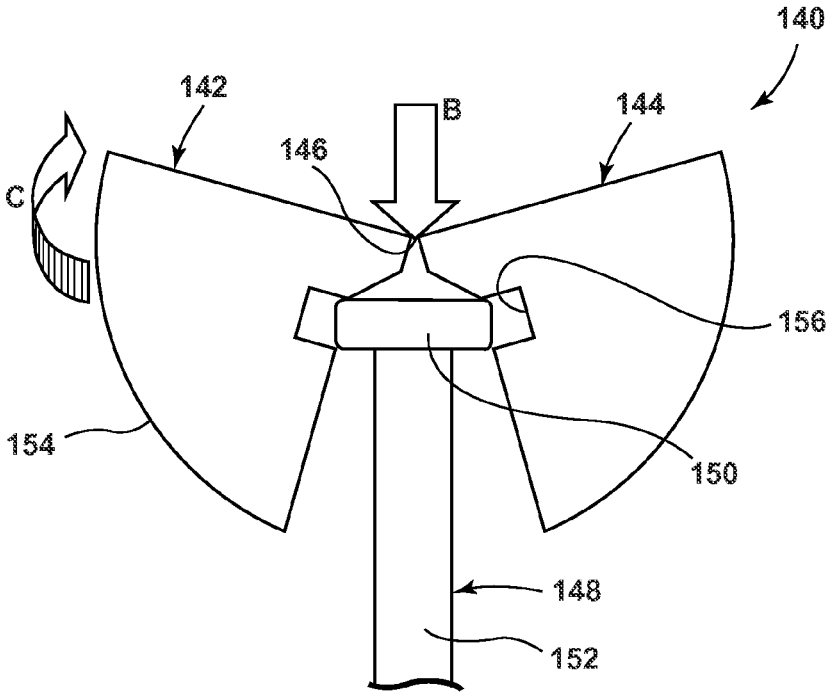
Figure 10C:
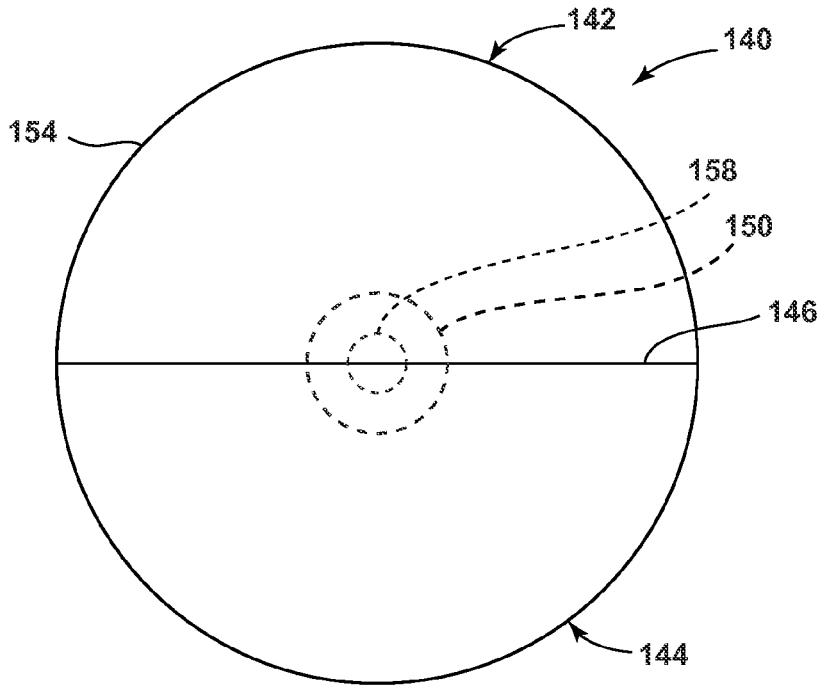

FIGS. 10A-C illustrate a fourth embodiment recess insert 140 for use with a lifting pin anchor 148 having a circular lifting pin head 150 and a cylindrical lifting pin shaft 152. The recess insert 140 comprises a pair of quadrant inserts 142, 144 that can be coupled together to define a hemispherical wall 154. Each quadrant insert can have half of a conical recess 158 and half of a lifting pin head cavity 156. After the concrete has cured, the recess insert 140 can be removed from the lift anchor cavity 32 by pressing down on the center of the recess insert 140 along a pivotal joint 146, thereby urging the quadrant inserts 142, 144 away from the lifting pin anchor 148 and enabling removal of the insert 140.

Figure 10D:
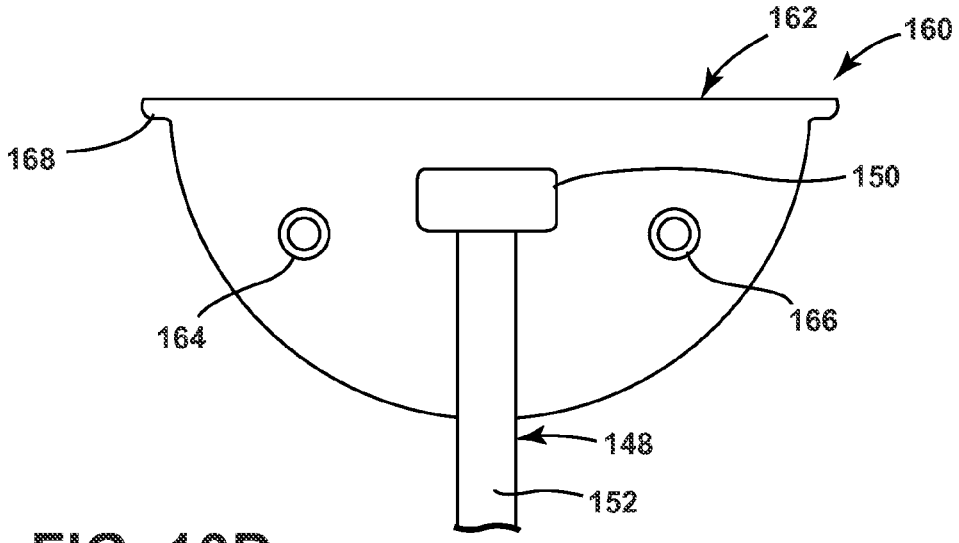
FIG. 10D is a schematic elevation view of the recess insert of FIGS. 10A-C illustrating a means of coupling a pair of recess inserts together.

FIG. 10D illustrates a fifth embodiment recess insert 160 comprising a pair of quadrant inserts 162 (only one of which is illustrated) for use with the lifting pin anchor 148. The quadrant inserts 162 have identical cavities for receiving one half of the circular lifting pin head 150 and lifting pin shaft 152 when the quadrant inserts are coupled together. The quadrant inserts 162 can each include a half flange extending along the circumference of the recess insert 160. The joining wall can be provided with recess insert connectors, 164, 166 similar to the openings and spherical head fasteners previously described herein. Removal of the recess insert 160 can be generally as described hereinbefore.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A recess insert for pre-cast Portland cement concrete shapes, the recess insert comprising:

a one-piece quadrant-shaped body characterized by a longitudinal plane of symmetry, the quadrant-shaped body including a planar obverse wall characterized by an obverse plane, a planar contact wall characterized by a contact plane, and a convex curved wall, the walls collectively joined so that the longitudinal plane of symmetry bisects each of the planar obverse wall, planar contact wall, and convex curved wall;

a perimetric flange integral with the quadrant-shaped body and coplanar with the obverse wall, beginning at the contact wall and transitioning to a triangular projection bisected by the longitudinal plane of symmetry, the perimetric flange characterized by a width adjacent the contact wall, and a depth of the triangular projection along the longitudinal plane of symmetry, the depth being greater than the width;

the contact plane and obverse plane intersecting orthogonally along a contact line disposed orthogonal to the longitudinal plane of symmetry;

the convex curved wall coupled with the planar obverse wall and the planar contact wall radially opposite the contact line;

wherein a bilaterally symmetrical open channel traverses the planar contact wall and intercepts the convex curved wall at two locations for holding a lifting anchor;

wherein a pair of quadrant-shaped bodies are mutually joinable along the planar contact walls to form the recess insert, define a closed channel to enclose a portion of a lift anchor, and define a 180° semicircular convex curved wall; and wherein the perimetric flange is supportable upon a concrete surface, whereupon each quadrant-shaped body is individually removable from cured concrete by lifting the triangular projection away from a cured concrete surface.

2. A recess insert in accordance with claim 1 wherein a first one of the pair of quadrant-shaped bodies includes at least one opening penetrable by a fastener.

3. A recess insert in accordance with claim 2 wherein the at least one opening is in the planar contact wall.

4. A recess insert in accordance with claim 2 wherein the fastener is one of a friction fastener and a threaded fastener.

5. A recess insert in accordance with claim 4 wherein the friction fastener includes a spherical head, and the spherical head is insertable into at least one opening in a quadrant-shaped body.

6. A recess insert in accordance with claim 5 wherein a second one of the pair of quadrant-shaped bodies includes at least one opening in the planar contact wall and the spherical head is insertable therein.

7. A recess insert in accordance with claim 5 wherein the friction fastener is insertable in the at least one opening in at least one of the pair of quadrant-shaped bodies so that the spherical head projects beyond the planar contact wall.

8. A recess insert in accordance with claim 1 wherein the quadrant-shaped bodies are identical.

9. A recess insert in accordance with claim 1 wherein fresh Portland cement concrete is placeable in contact with the semicircular convex wall defined by the pair of quadrant-shaped bodies, and around a lift anchor partially receivable in the closed channel, to define a recess in placed Portland cement concrete exposing part of a lift anchor, and after at least partial curing of placed Portland cement concrete, the quadrant-shaped bodies are separable from a lift anchor by lifting the flanges away from placed Portland cement concrete to rotate the quadrant-shaped bodies out of a semicircular cavity.

10. A recess insert in accordance with claim 1 wherein a pair of quadrant-shaped bodies are connectable by a pivotal joint enabling rotation of the quadrant-shaped bodies about a transverse axis.

11. A recess insert in accordance with claim 10 wherein the pivotal joint is one of a separate flexible strap, a hinge, or an extension of the planar obverse wall.

12. A recess insert in accordance with claim 1, and further comprising a pair of opposed parallel planar sidewalls transitioning from the planar obverse wall and the planar contact wall to the convex curved wall.

13. A recess insert in accordance with claim 12 wherein the planar sidewalls transition orthogonally from the planar obverse wall and the planar-contact wall.

14. A lifting assembly for pre-cast Portland cement concrete shapes, the lifting assembly comprising:

a recess insert characterized by a longitudinal plane of symmetry, comprising a coupleable pair of one-piece quadrant-shaped bodies, each body including a planar obverse wall characterized by an obverse plane, a planar contact wall characterized by a contact plane, and a convex curved wall, the walls collectively joined so that the longitudinal plane of symmetry bisects each of the planar obverse walls, planar contact walls, and convex curved walls; and a Portland cement concrete lifting anchor characterized by a pair of angularly disposed anchor legs joined at an angular bend;

a perimetric flange integral with a quadrant-shaped body and coplanar with the obverse wall, beginning at the contact wall and transitioning to a triangular projection bisected by the longitudinal plane of symmetry, the perimetric flange characterized by a width adjacent the contact wall, and a depth of the triangular projection along the longitudinal plane of symmetry, the depth being greater than the width;

the contact plane and obverse plane intersecting orthogonally along a contact line disposed orthogonal to the longitudinal plane of symmetry; and the convex curved wall coupleable with the planar obverse wall and the planar contact wall radially opposite the contact line;

wherein a bilaterally symmetrical open channel traverses the planar contact wall and intercepts the convex curved wall at two locations for holding a lifting anchor; and wherein the pair of quadrant-shaped bodies are mutually joinable along the contact walls to define a 180° semicircular convex wall, juxtapose the open channels, and define a closed channel for enclosing a portion of the lift anchor; and wherein the perimetric flange is supportable upon a concrete surface, whereupon the recess insert is removable from cured concrete by lifting the triangular projection of each quadrant-shaped body away from a cured concrete surface.

15. A lifting assembly in accordance with claim 14 wherein a first one of the pair of quadrant-shaped bodies includes at least one opening penetrable by a fastener.

16. A lifting assembly in accordance with claim 15 wherein the at least one opening is in the planar-contact wall.

17. A lifting assembly in accordance with claim 15 wherein the fastener is one of a friction fastener and a threaded fastener.

18. A lifting assembly in accordance with claim 17 wherein the friction fastener includes a spherical head, and the spherical head is insertable into at least one opening in a quadrant-shaped body.

19. A lifting assembly in accordance with claim 18 wherein a second one of the pair of quadrant-shaped bodies includes at least one opening in the planar-contact wall and the spherical head is insertable therein.

20. A lifting assembly in accordance with claim 14 wherein the quadrant-shaped bodies are identical.

21. A lifting assembly in accordance with claim 14 wherein fresh Portland cement concrete is placeable in contact with the semicircular convex wall defined by the pair of quadrant-shaped bodies, and around the lift anchor partially received in the closed channel, to define a semicircular recess in placed Portland cement concrete exposing the angular bend, and after at least partial curing of placed Portland cement concrete, the quadrant-shaped bodies can be separated from the lift anchor by lifting the flanges away from the placed Portland cement concrete to rotate the quadrant-shaped bodies out of the semicircular recess.

22. A lifting assembly in accordance with claim 14 wherein the pair of quadrant-shaped bodies are connectable by a pivotal joint enabling rotation of the quadrant-shaped bodies about a transverse axis.

23. A lifting assembly in accordance with claim 22 wherein the pivotal joint is one of a separate flexible strap, a hinge, or an extension of the planar obverse wall.

* * * * *